US005121858A

United States Patent [19]

Chong

[11] Patent Number: 5,121,858

[45] Date of Patent: Jun. 16, 1992

[54] PRESSURE RELIEF SYSTEM

[76] Inventor: Wun C. Chong, 69 Wallace Place, Delta, B.C., Canada, V4M 3S2

[21] Appl. No.: 579,359

[22] Filed: Sep. 7, 1990

[51] Int. Cl.[5] ..... B65D 83/00

[52] U.S. Cl. ..... 222/397; 220/203; 220/366; 137/467

[58] Field of Search ..... 220/89.1, 203, 208, 220/366; 137/467; 222/397, 396, 402.1

[56] References Cited

U.S. PATENT DOCUMENTS

| | | | |
|---|---|---|---|
| 2,024,512 | 12/1935 | Darling | 220/203 |
| 2,670,755 | 3/1954 | Kendrick | 137/467 |
| 2,702,046 | 2/1955 | Zimmer et al. | 137/467 |
| 2,795,350 | 6/1957 | Lapin | 220/89 |
| 2,822,961 | 2/1958 | Seaquist | 222/397 |
| 2,951,614 | 9/1960 | Greene | 220/89 |
| 3,074,602 | 1/1963 | Shillady | 222/397 |
| 3,245,578 | 4/1966 | Sutton | 220/89 |
| 3,270,924 | 9/1966 | Kitabayashi | 222/402.1 |
| 3,283,960 | 11/1966 | Williams | 222/397 |
| 3,405,838 | 10/1968 | Preisendanz . | |
| 3,450,305 | 6/1969 | Kinnavy et al. | 222/397 |
| 3,515,308 | 6/1970 | Hayes et al. . | |
| 3,680,743 | 8/1972 | Reinnagel | 222/397 |
| 3,724,727 | 4/1973 | Zundel | 222/397 |
| 3,786,967 | 1/1974 | Giocomo et al. | 222/397 |
| 3,815,534 | 6/1974 | Kneusel | 222/397 |
| 3,826,412 | 7/1974 | Kneusel | 222/397 |
| 3,831,822 | 3/1974 | Zundel | 222/397 |
| 3,850,339 | 11/1974 | Kinkel | 222/397 |
| 3,880,187 | 4/1975 | Kneusel | 222/397 |
| 4,003,505 | 1/1977 | Hardt | 222/397 |
| 4,143,787 | 3/1979 | Walker | 220/203 |
| 4,267,858 | 5/1981 | Lewis | 137/467 |
| 4,416,388 | 11/1983 | Mulawski | 222/397 |
| 4,513,874 | 4/1985 | Mulawski | 222/397 |
| 4,576,303 | 3/1986 | Mundt et al. | 220/89 |
| 4,588,101 | 5/1986 | Ruegg | 222/397 |

FOREIGN PATENT DOCUMENTS

| | | | |
|---|---|---|---|
| 147318 | 7/1952 | Australia | 137/467 |
| 1925264 | 7/1978 | Fed. Rep. of Germany | 220/203 |
| 1142651 | 9/1957 | France | 220/366 |
| 84240 | 1/1958 | Netherlands | 220/203 |

*Primary Examiner*—Michael S. Huppert
*Assistant Examiner*—Kenneth Bomberg
*Attorney, Agent, or Firm*—Christie, Parker & Hale

[57] ABSTRACT

A pressure relief system for a pressurized container having an aperture comprising a closure member adapted for insertion into the aperture. The closure member has a bottom wall and peripheral side walls and a seal adapted to engage and seal the edges of the aperture. The peripheral side walls are formed with a first set of radially outwardly extending projections adapted to engage with the edges of the aperture to hold the seal of the closure member into sealable engagement over the aperture. A second set of radially outwardly extending projections are also provided below the first set adapted to engage with the aperture edge to hold the closure member within the aperture when the first set of projections are forced out of engagement with the aperture edge due to a build up of excess pressure in the pressurized container whereby the seals are released from the aperture edge to vent pressure. A tool is also disclosed capable of forming the necessary first and second sets of projections in a single step.

8 Claims, 3 Drawing Sheets

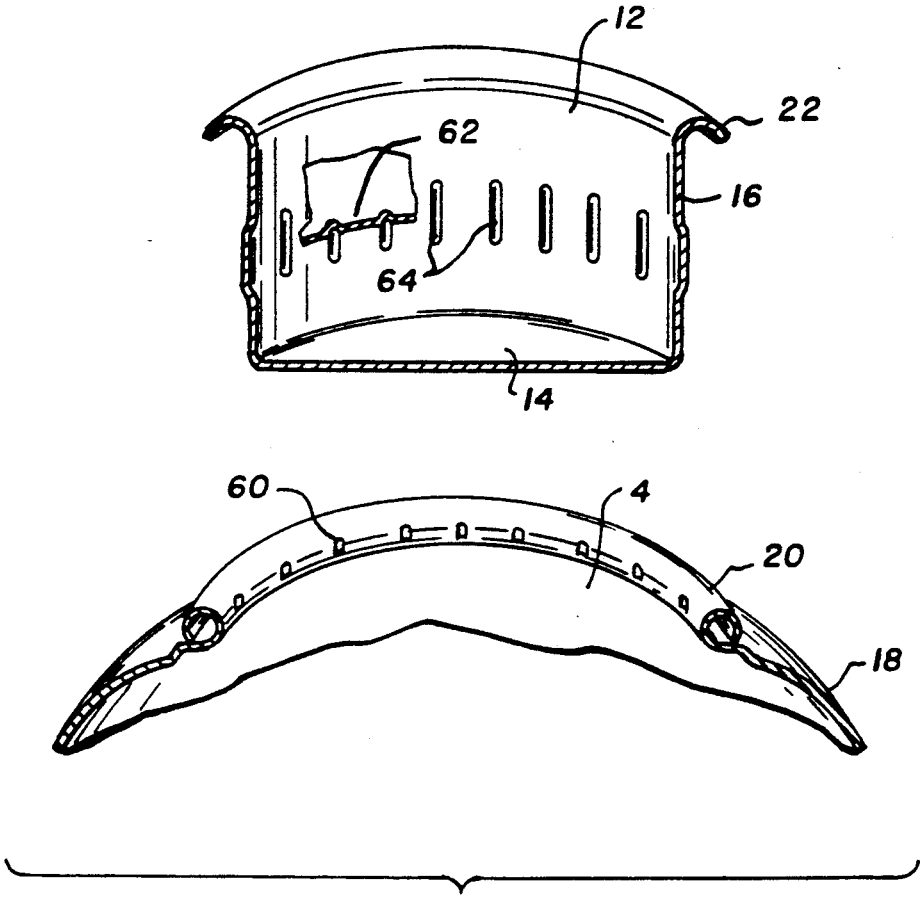
Fig. 7.
Fig. 8.
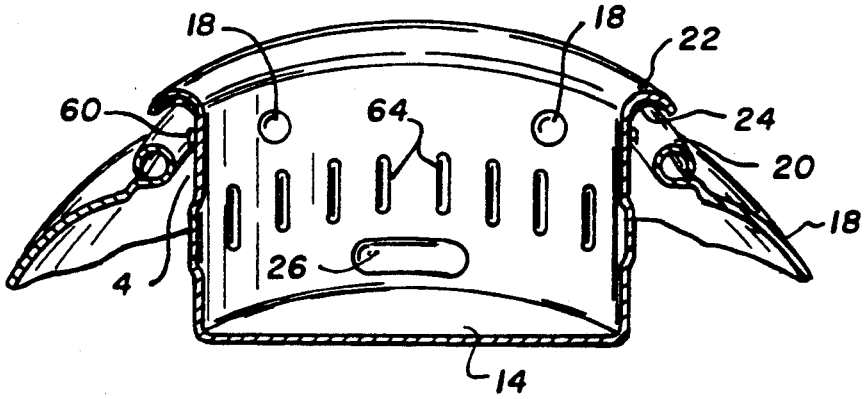

PRESSURE RELIEF SYSTEM

FIELD OF THE INVENTION

This invention relates to a pressure relief system for use with pressurized containers, particularly aerosol dispenser cans, and also to a tool for forming the closure member used with the pressure relief system.

BACKGROUND OF THE INVENTION

Pressurized containers are in common use today for packaging and dispensing various fluid products. Particularly popular are aerosol cans. In general, these containers are safe and reliable, however, under certain conditions, such as exposure to high heat, the containers are liable to rupture violently due to build up of excessive internal pressure from expansion of the can contents. The rupturing of the pressurized container often results in fragments of the container being ejected at great speed and these fragments can do a great deal of damage or cause injuries.

In the past, numerous attempts have been made to solve the problem of explosive rupturing of pressurized containers. A common solution has been to provide weakened areas in the walls or base of the container designed to safely rupture and vent excess pressure at pressures below those that would cause more violent ruptures. Examples of this type of system are found in the following patents:

U.S. Pat. No. 2,795,350 to Lapin
U.S. Pat. No. 2,951,614 to Greene
U.S. Pat. No. 3,074,602 to Shillady
U.S. Pat. No. 3,283,960 to Williams
U.S. Pat. No. 3,724,727 to Zundel
U.S. Pat. No. 3,786,967 to Giocomo et al.
U.S. Pat. No. 3,815,534 to Kneusel
U.S. Pat. No. 3,826,412 to Kneusel
U.S. Pat. No. 3,831,822 to Zundel
U.S. Pat. No. 3,850,339 to Kinkel
U.S. Pat. No. 4,003,505 to Hardt
U.S. Pat. No. 4,416,388 to Mulawski
U.S. Pat. No. 4,513,874 to Mulawski
U.S. Pat. No. 4,576,303 to Mundt et al.
U.S. Pat. No. 4,588,101 to Ruegg A serious drawback to these weakened areas is that they are prone to breakage and leakage of the container contents during normal handling and use.

Other techniques to solve the problem of rupturing have involved the use of auxiliary pressure relief valves incorporated in the container wall as shown in U.S. Pat. Nos. 3,245,578 to Sutton, 3,405,838 to Preisendanz and 3,515,308 to Hayes et al.

U.S. Pat. No. 3,680,743 to Reinnagel shows a safety venting system that uses a sharpened barb to pierce the wall of the container as it expands due to excess pressure.

U.S. Pat. No. 3,450,305 discloses venting means for a container that employs an end closure that is adapted to separate from the container when excess internal pressure is created due to heating. The disadvantage of this arrangement is that the separation of the end closure can often be quite violent and the expelled end closure can be as dangerous as the shrapnel of an exploded container.

SUMMARY OF THE INVENTION

There is a need for a pressure relief system for containers that avoids the problems of the prior art. The invention of the present application provides a pressure relief system that is safe and reliable and is not prone to activation during normal handling and use. The pressure relief system automatically vents pressure from a container when its contents exceed a safe internal pressure level without risk of the venting operation creating flying shrapnel.

Accordingly, in a first embodiment, the present invention provides a pressure relief system for a pressurized container having an aperture comprising:

a closure member adapted for insertion into said aperture having a bottom wall and peripheral side walls, said closure member having sealing means adapted to engage and seal the edges of said aperture, said peripheral side walls being formed with a first set of radially outwardly extending projections adapted to engage with the edges of said aperture to hold said sealing means of said closure member into sealable engagement over said aperture, and a second set of radially outwardly extending projections below said first set adapted to engage with said aperture edge to hold said closure member within said aperture when said first set of projections are forced out of engagement with said aperture edge due to a build up of excess pressure in the pressurized container whereby said sealing means are released from said aperture edge to vent off pressure.

The present invention also provides a tool for forming the above mentioned projections in the side walls of an essentially cylindrical member, particularly the closure member. The tool comprises an outer sleeve adapted to be inserted within the sidewalls of the member;

a rotatable inner housing member mounted within said outer sleeve;

projection forming means adapted to be biased outwardly of said outer sleeve upon rotation of said rotatable inner housing member within said outer sleeve in order to engage and deform the sidewalls of said cylindrical member to form projections.

BRIEF DESCRIPTION OF THE DRAWINGS

Aspects of the present invention are illustrated, merely by way of example, in the accompanying drawings in which:

FIG. 7 is a section view showing an alternative embodiment of the present invention with venting means in the closure member and the container aperture; and FIG. 8 is an assembled section view showing the vented closure member and container aperture of FIG. 7.

DESCRIPTION OF THE PREFERRED EMBODIMENTS

Figure 1:
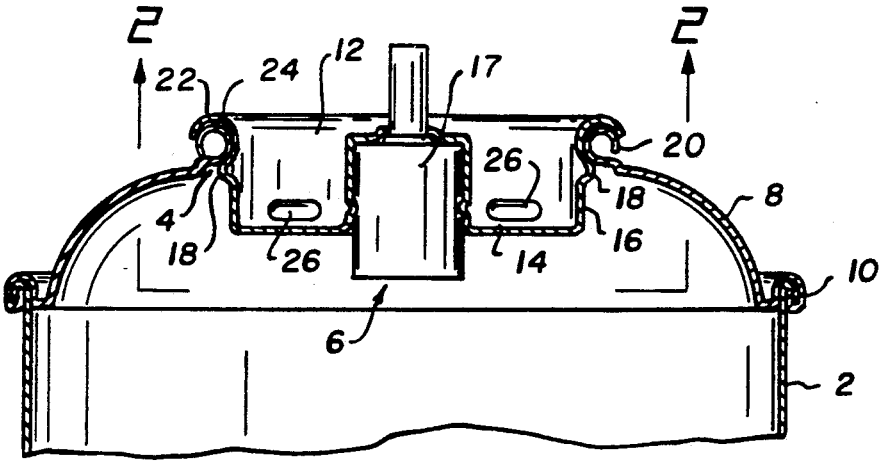
FIG. 1 is a rotated cross-sectional view through a typical pressurized container showing the closure member of the present invention in place to seal the container.

A pressurized container 2 with an upper aperture 4 is shown in FIG. 1, with the pressure relief system 6 of the present invention installed in place. Pressurized container 2 is of standard construction and employs an apertured end cap 8 attached to the cylindrical body of the container by a rolled seam joint 10.

A closure member 12 according to the present invention is in position within aperture 4 and acts to seal the container and its pressurized contents. Closure member 12 is an essentially cup shaped member having a bottom wall 14 and peripheral side walls 16. The closure member is dimensioned for insertion into aperture 4 and the side walls are formed with first and second sets of radially outwardly extending projections. Preferably, the projections are formed by deforming the side walls of the closure member. The closure member is also provided with a central manually container contents.

In the illustrated preferred embodiment, the first upper set of projections are circular protrusions 18 arranged at intervals about the side wall. Protrusions 18 engage below the edge of aperture 4 and hold the closure member in sealing engagement within the aperture. To assist in sealing of the container, aperture 4 is formed with a rolled edge 20 and side walls 16 are formed with an upper lip 22 housing sealing means in the form of a resilient 0-ring 24. Protrusions 18 are formed at a distance below upper lip 22 such that 0-ring 24 is compressed to an extent sufficient to seal the container when closure member 12 is in place.

Figure 2:
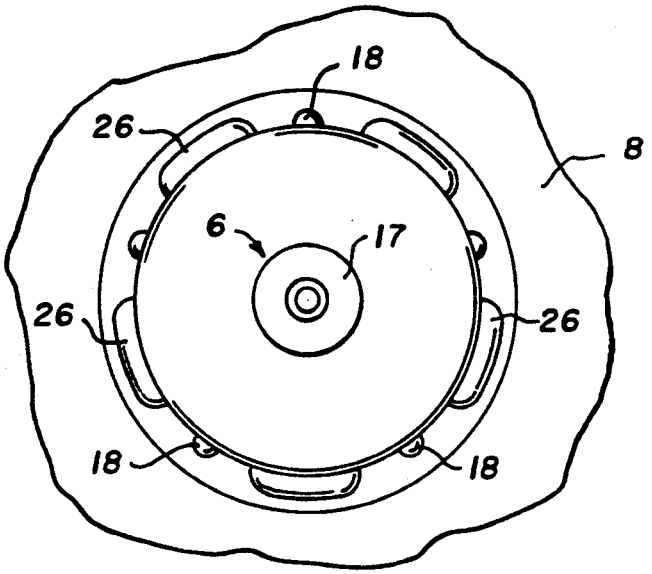
FIG. 2 is a view of the closure member taken along line 2—2 of FIG. 1.

The second lower set of projections are preferably in the form of elongate tabs 26. As best shown in FIG. 2, which is a view from the underside of the closure member, elongate tabs 26 are formed at evenly spaced intervals about the periphery of side wall 16 below and between adjacent protrusions 18 of the first upper set of projections.

Figure 1A:
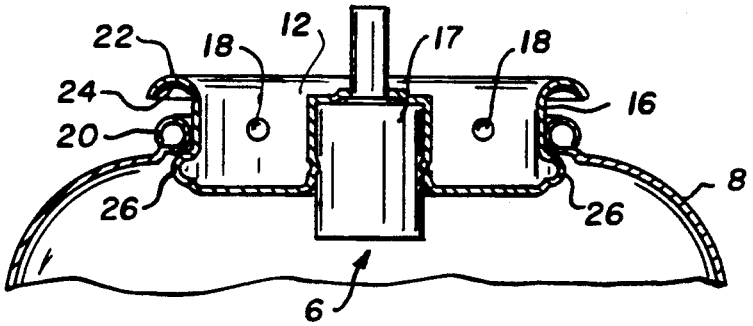
FIG. 1*a* is a rotated cross-sectional view through the pressurized container of FIG. 1 showing the closure member in a position to allow venting of the container contents.

Lower elongate tabs 26 are not employed during regular use, however, if the internal pressure of the container should rise above a safe level due to heating or some other cause, protrusions 18 are dimensioned to give way below the aperture edge to allow 0-ring 24 to unseat thereby allowing the contents of the container to vent away to atmosphere and disperse the pressure build up. Once protrusions 18 release, the closure member will tend to be expelled from the container at great speed. Elongate tabs 26 are provided to engage beneath the aperture edge to prevent the closure member from leaving the container to become a dangerous projectile. This venting position of the closure member is shown in FIG. 1*a*. The spaces between elongate tabs 26 provide passages for the venting contents of the container to escape to atmosphere. It is desirable that the first set of upper projections be made smaller than the second lower set to ensure that the first set will release appropriately due to excess pressure build up and the second set will be substantial enough to prevent release of the closure member from the container once the first set has given way.

While the first and second sets of protrusions are shown as being separate and offset in the illustrated embodiments, it will be understood that these protrusions can be formed as a combined member with a smaller upper protrusion portion being centred directly above each lower tab projection portion. , The pressure relief system of the present invention is quickly and efficiently installed using the tool illustrated in FIGS. 3 to 6.

Figure 3:
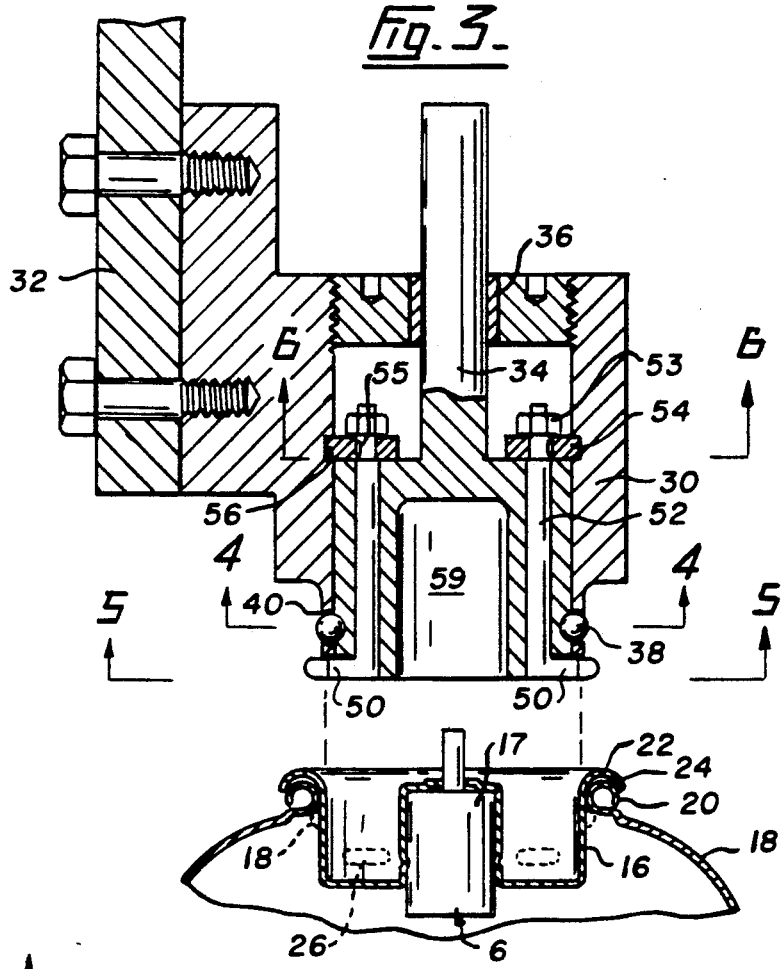
FIG. 3 is a sectional view through the tool used to form the retaining projections in the closure member.

Referring to FIG. 3, a tool according to the present invention is shown just prior to sealing a closure member on a container. The tool includes an outer sleeve 30 adapted to be inserted within the sidewalls of a closure member. The outer sleeve can be attached to a support arm 32 of an assembly line unit or other equipment capable of raising and lowering the tool. Within the outer sleeve, there is a rotatable inner housing member 34 supported by bearings 36. There are projection forming means adapted to be biased outwardly of the outer sleeve upon rotation of the rotatable inner housing member 34. The projection forming means engage and deform the sidewalls of the cylindrical member to form the sets of projections necessary for the closure member of the present invention.

In the illustrated embodiment, there are two sets of projections forming means that act simultaneously to form the necessary two sets of projections in the side walls of the closure member. These projections are formed by the tool with the closure member 12 in place on the container 2 so that a completed container is created after the tool has performed its task.

Figure 4:
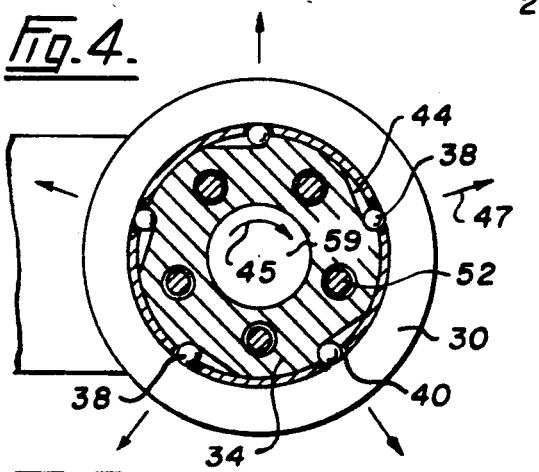
FIG. 4 is a section view taken along line 4—4 of FIG. 3 showing the ball bearing members of the tool.

Projection forming means to form protrusions 18 are provided in the form of a series of ball bearings 38 that are extendable through apertures 40 in outer sleeve 30. As best shown in FIG. 4, each ball bearings 38 is acted on by a cammed driving surface 44 formed on rotatable inner housing 34. As housing 34 is rotated in the direction of arrow 45 driving surfaces 44 force ball bearings 38 outwardly of the outer sleeve as indicated by arrows 47. The ball bearings are forced into the side walls of the closure member to form rounded protrusions 18.

Figure 6:
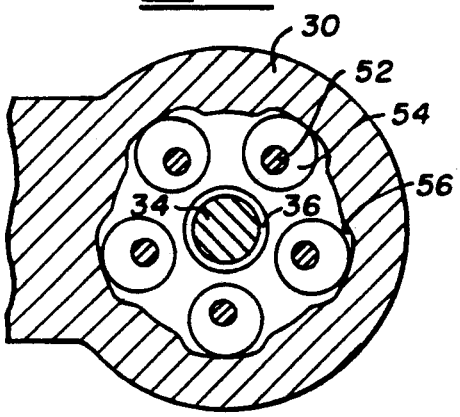
FIG. 6 is a section view taken along line 6—6 of FIG. 3 showing the cam track formed in the outer sleeve.

An additional set of projection forming means are used to form the elongate tabs 26 of the closure member. A plurality of blade members 50 are rotatably mounted within inner housing member 34. The blade members are rigidly mounted to rotatable shafts 52 that extend through the inner housing member. At its upper end, each shaft 52 is fitted with a cam follower 54 that engages a cam surface 56 formed on the inner surface of outer sleeve 30 as best shown in FIG. 6. Each cam follower 54 is held on a shaft 52 by nut 53 which engages an upper threaded portion of the shaft. Key 55 ensures that no rotation of the shaft with respect to the follower is possible. This two-part nut and shaft arrangement allows for insertion and assembly of the shafts within the inner housing when upper bearing 36 is removed from the top of the outer sleeve 30.

Figure 5:
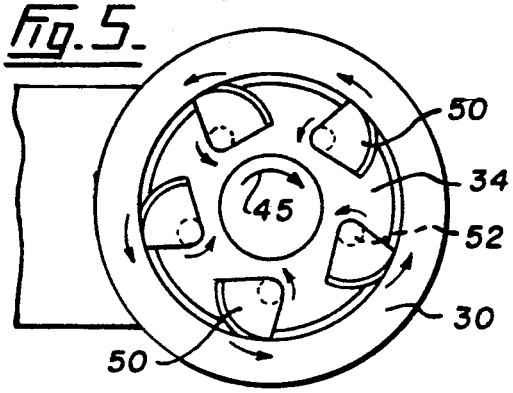
FIG. 5 is a section view taken along line 5—5 of FIG. 3 showing the blade members of the tool.

Rotation of inner housing member 34 with respect to outer sleeve 30 results in movement of follower 54 along cam surface 56 as shafts 52 move with the inner housing. Cam surface 56 is arranged to cause rotation of shafts 52 such that attached blade members 50 are rotated outwardly of the outer sleeve to engage and deform the side walls 16 of the closure member to create elongate tabs 26. The rotation of the blade members is best shown in FIG. 5.

It will be appreciated that both sets of projection forming means operate simultaneously during the rotation of the inner housing. The inner housing is always rotated in the same direction and the forming process can be repeated as many times as is necessary to established well defined projections in the side walls of the closure member.

If necessary, inner housing member 34 can be formed with an internal cavity 59 to accommodate any valve member present in the closure member.

An alternative embodiment of the pressure relief system is shown in FIGS. 7 and 8 in which similar features as found in previous embodiments are labelled with the same reference numerals. In this embodiment, the closure member 12 and aperture 4 are formed with venting means to facilitate the escape of the pressurized contents of the container when the closure member is forced into the venting position. The venting means take the form of venting channels 60 formed about the interior of rolled edge 20 of aperture 4. In closure member 12, the venting means comprise external passages 62 defined by protruding ridges 64 press formed into the side walls 16 of the closure member. Preferably, ridges 64 are formed by a splined member inserted within the interior of the closure member prior to sealing of the closure member within aperture 4. FIG. 7 shows the closure member and container aperture as they would appear prior to the sealing process previously described. FIG. 8 shows the same closure member and container after the member has been sealed atop the container using tool 30. If excess pressure builds up in the container and forces the closure member upwardly to its venting position, passages 62 and channels 60 will provide escape routes in which the expelled container contents can travel thereby improving the rate at which the container is exhausted to avoid the possibility of prolonged excess pressure overcoming the holding force of the elongate slots 26 and blowing out the closure member.

Although the present invention has been described in some detail by way of example for purposes of clarity and understanding, it will be apparent that certain changes and modifications may be practiced within the scope of the appended claims.

I claim:

1. A pressure relief system for a pressurized container having an aperture with a peripheral edge comprising:

a closure member adapted for insertion into said aperture and having a bottom wall and a peripheral side wall, said closure member having sealing means adapted to seal said aperture, said peripheral side wall being formed with a first set of radially outwardly extending projections adapted to engage the edge of said aperture to hold said sealing means of said closure member in sealable engagement over said aperture, and a second set of radially outwardly extending projections below said first set, said closure member being movable between sealable engagement over said aperture and a venting position in which excess pressure in the pressurized container forces said first set of projections out of engagement with said aperture edge to release said sealing means from said aperture to vent pressure, said second set of radially outwardly extending projections engaging with the edge of said aperture to retain said closure member within said aperture during venting of pressure, said closure member having venting means comprising passages in the peripheral side wall of said closure member defined by raised ridges formed in said side wall to facilitate release of the container contents when said closure member is forced into said venting position.

2. A pressure relief system as claimed in claim 1 in which said first set of projections are smaller than said second set of projections.

3. A pressure relief system as claimed in claim 1 in which said projections of said first set are spaced above and between adjacent spaced projections of said second set.

4. A pressure relief system as claimed in claim 1 in which said projections are formed by deforming the side wall of said closure member.

5. A pressure relief system as claimed in claim 1 in which said aperture is formed with a rolled edge and said sidewall of said closure member is formed with an upper lip housing said sealing means and adapted to engage said rolled edge when said first set of projections are engaged below said rolled edge.

6. A pressure relief system is claimed in claim 5 in which said sealing means comprises a resilient O-ring.

7. A pressure relief system as claimed in claim 1 in which said closure member is provided with a manually operated dispensing valve.

8. A pressure relief system as claimed in claim 1 in which said closure member is generally cup shaped.

* * * * *

UNITED STATES PATENT AND TRADEMARK OFFICE

CERTIFICATE OF CORRECTION

PATENT NO. : 5,121,858

DATED : June 16, 1992

INVENTOR(S) : Wun C. Chong

It is certified that error appears in the above-identified patent and that said Letters Patent is hereby corrected as shown below:

On the title page:

[56] References Cited, U.S. PATENT DOCUMENTS, change "3,831,822 3/1974 Zundel..." to -- 3,831,822 8/1974 Zundel... --.

Column 3, line 23, after "manually" insert -- operated delivery valve 17 for normal dispensing of the --.

Columns 4, line 68 and column 5, line 1, change "established" to -- establish --.

Signed and Sealed this

Seventh Day of September, 1993

Bruce Lehman

*Attest:*

BRUCE LEHMAN

*Attesting Officer*

*Commissioner of Patents and Trademarks*